United States Patent [19]

Kalan

[11] 4,299,419

[45] Nov. 10, 1981

[54] FIREPLACE ASH CLEANING SHOVEL

[76] Inventor: Joseph F. Kalan, P.O. Box 1, Diamondville, Wyo. 83116

[21] Appl. No.: 131,059

[22] Filed: Mar. 17, 1980

[51] Int. Cl.[3] ..... A47F 13/08

[52] U.S. Cl. ..... 294/55; 294/9

[58] Field of Search ..... 294/9, 50.9, 55, 53.5, 294/49, 50.8; 15/257.1, 257.2, 257.5, 257.6

[56] References Cited

U.S. PATENT DOCUMENTS

| | | | |
|---|---|---|---|
| 637,908 | 11/1899 | Vroman | 294/55 |
| 1,762,347 | 6/1930 | Peebles | 294/55 |
| 2,315,831 | 4/1943 | Wilcox | 294/55 |

*Primary Examiner*—James B. Marbert

*Attorney, Agent, or Firm*—W. Britton Moore

[57] ABSTRACT

A fireplace ash cleaning shovel having a generally rectangular base chamber with a sloping ash receiving front and a flat lid hinged thereto and having a downwardly depending angled front for hingedly closing the base chamber. An elongated hollow handle, attached to the rear wall of the base chamber and projecting at right angles therefrom, receives an elongated operating rod with bent extremities thereon so that manual rotation of the bent rear end causes the bent forward end to engage with and elevate the lid against spring pressure. When opened, the shovel may be inserted into a fireplace and filled with ashes, after which the lid is lowered to permit removal of the shovel and emptying and disposal of the ashes exteriorly of the fireplace.

3 Claims, 5 Drawing Figures

FIG.1
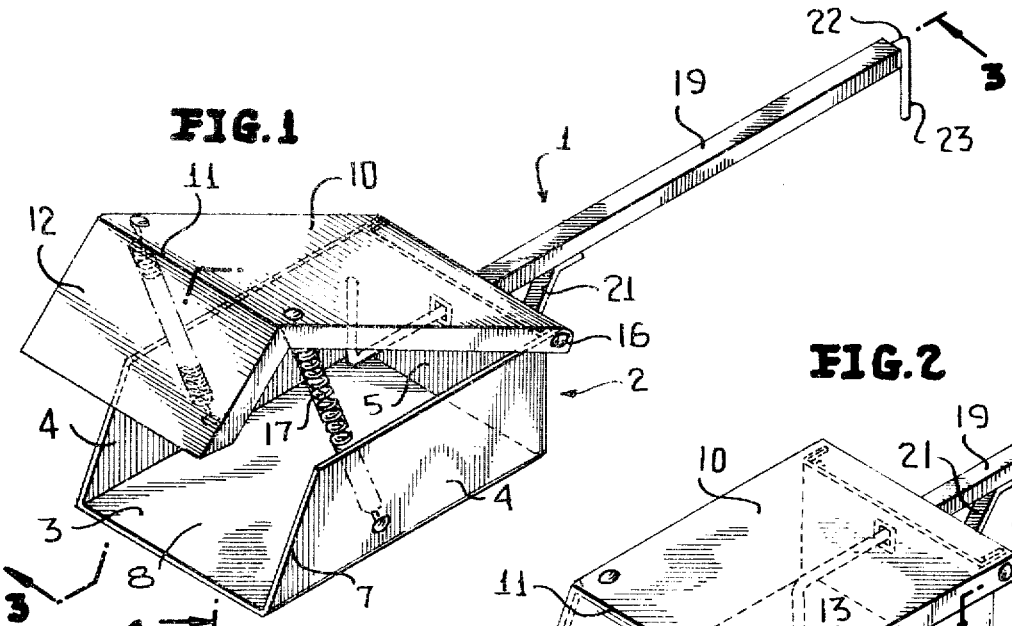
FIG.2
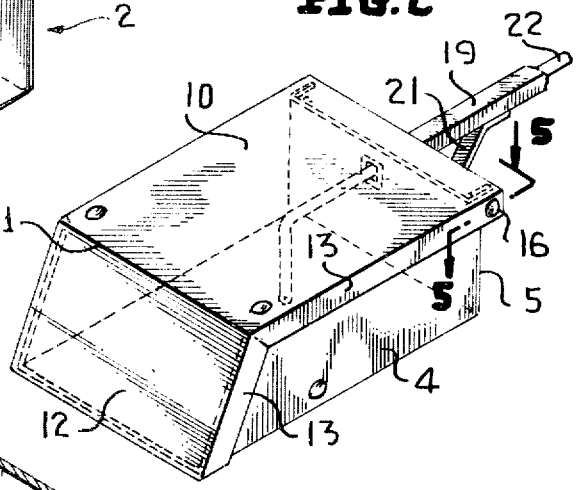
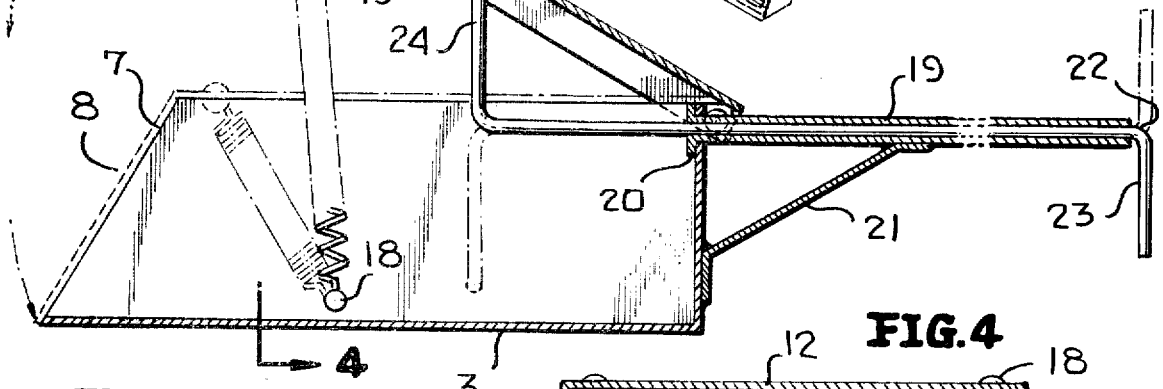
FIG.3
FIG.4
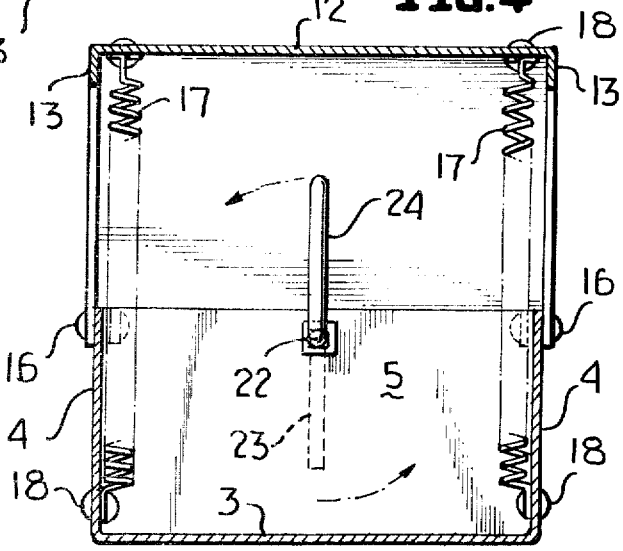
FIG.5
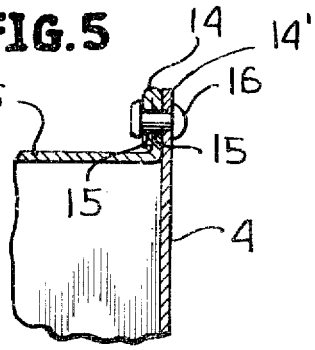

FIREPLACE ASH CLEANING SHOVEL

BACKGROUND OF THE INVENTION

The present invention relates to a fireplace ash cleaning shovel having an elongated handle with an actuating rod therein for tiltably elevating the lid to permit loading ashes thereinto for removal and disposal exteriorly of the fireplace.

While various stove and furnace cleaning implements have heretofore been proposed, such as those represented by U.S. Pat. to Korjibsky Nos. 767,648, Stephanus 1,051,029, Rogaczewicz 1,882,934, and Nicholson 2,665,127, none of these devices is peculiarly adapted for fireplace cleaning by presenting a unitary self-contained handled device with a tiltable lid for introduction into a fireplace for sealable filling with ashes to permit removal and disposal thereof exteriorly without spillage.

Accordingly, it is the principal object of the present invention to provide a fireplace ash cleaning shovel having a generally rectangular open top base chamber with an open front end and a lid hinged thereto and tiltable by rotation of a handle arranged in an elongated handle attached to the base.

Another object is the provision of a fireplace ash cleaning shovel having a generally rectangular base chamber with a tapered open front end covered by a hinged lid tiltable to open ash receiving position by the bent end of an elongated rod rotatably arranged in an elongated handle attached to the closed rear end of the base.

Still another object is to provide a fireplace ash receiving shovel wherein the lid is formed with a downwardly angled front end for sealably covering the base chamber, and which is hingedly spring mounted thereon for tiltable upward movement by the bent end of an actuating rod for opening the front end for entry of ashes therethrough, with the lid being sealably closeable by spring action when the bent rod end is disengaged therefrom.

A further object is the provision of a fireplace ash receiving shovel wherein the main component parts thereof are readily and inexpensively formable from sheet metal to provide a sturdy and sealable ash receiving chamber.

These and other objects and advantages will be apparent as the specification is considered with the accompanying drawings, wherein FIG. 1 is a perspective view of the ash receiving shovel in open ash receiving position;

FIG. 2 is a perspective view of the ash receiving chamber portion of the shovel in closed and sealed position;

FIG. 3 is a section on the line 3—3 of FIG. 1;

FIG. 4 is a section on the line 4—4 of FIG. 3; and

FIG. 5 is a section on the line 5—5 of FIG. 2.

DETAILED DESCRIPTION

Referring more particularly to the drawings, wherein similar reference characters designate like parts throughout the several views, numeral 1 generally refers to the ash receiving shovel including a generally rectangular base chamber 2 having a flat bottom wall 3, upright side walls 4, rear wall 5. The upper end of chamber 2 is open, as at 6, and the forward ends of the side walls slope upwardly and rearwardly, as at 7, to provide an open front end 8.

A generally rectangular lid 9 is formed with a flat wall portion 10 bent, as at 11, to provide a depending forwardly and angularly extending flat forward wall section 12 which overhangs and covers the open forward end 6 of chamber 2 when in the closed position of FIG. 2. The side and rear edges of the lid are bent downwardly to provide mitered flanges 13 which sealably overlap the edges of upright side and rear walls 4-5 of base chamber 2, as best shown in FIG. 2. The lid may be suitably hinged to chamber 2, such as by providing rearwardly bent right angled tabs 14 at the upper corners of rear wall 5 which flatly engage and mate with tabs 14[1], formed at the upper corners of side walls 5. The tabs 14–14[1] are alignably apertured, as at 15, to receive headed hinge pins 16 therethrough so that the lid may be tiltably elevated, as shown in FIGS. 1 and 3, against the tension of a pair of spaced coil springs 17 which may be suitably anchored, as at 18, to the lid and bottom wall 3, for a purpose presently to be described.

Suitably attached to and projecting rearwardly at right angles to rear wall 5, as at 20, is an elongated square hollow handle tube 19, which may be additionally supported by an angled brace 21 suitably attached to the underside thereof and to wall 5. An elongated operating rod 22 is sleeved within handle tube 19 and is oppositely bent generally at right angles at its extremities to provide an upturned outer end 23 and an downturned inner end 24. By virtue of this arrangement, the handle tube 19 may be grasped in one hand and bent outer end 23 grasped and rotated downwardly by the other hand to rotate rod 22 in the handle and turn the bent inner rod end upwardly 24 until it engages the underside of lid 9, whereupon continued rotation thereof elevates and tilts the lid upwardly, against the pressure of coil springs 17, so that the angled forward wall section 12 of the lid is raised relative to the open end of base chamber 2, as best shown in FIGS. 1 and 3. Thus, the shovel may be slidably inserted within the grate section of a fireplace, not shown, and ashes and debris therefrom introduced into the chamber. When the latter has been sufficiently filled, it may be closed by further rotating outer rod end 23 to remove the inner rod end 24 out of supporting engagement with lid 9 and causes the same to be quickly snapped shut gravitationally aided by spring action, in an obvious manner. In such a closed position of FIG. 2, the lid sealably overlaps the edges of the chamber walls and retains the contents therein. The shovel may then be withdrawn from the fireplace and hand carried to an appropriate discharge point for reopening and emptying.

The shovel and component parts thereof may be made of suitable materials, such as metal or plastic. If the former, use of 18 gauge sheet metal enables the parts to be produced by conventional stamping or bending equipment.

While a preferred embodiment of fireplace ash cleaning shovel has been shown and described, it is to be understood that various changes and improvements may be made therein without departing from the scope and spirit of the appended claims.

What I claim is:

1. A fireplace ash cleaning shovel comprising a generally rectangular base chamber having a flat bottom wall and upstanding side and rear walls and open front and upper ends, a generally flat lid having a downturned forward wall section, said lid being hinged rearwardly of said chamber, the forward edges of said side walls being angled upwardly and rearwardly, and the downturned forward wall section of said lid being correspondingly angled to mate with and to close the open front end of said chamber, the side and rear edges of said lid being downwardly flanged to sealably overlap the walls of said chamber, elongated hollow handle means attached to and projecting rearwardly at generally right angles from the rear of said chamber, actuating rod means sleeved within said handle means and having oppositely bent ends, spring means including spaced coil springs interposed between and attached to said lid adjacent the downturned forward wall section and to said chamber, said outermost bent end being rotatable to cause the opposing bent end to engage with and tiltably elevate said lid against spring pressure to expose said open front end whereby said shovel may be slidably inserted into a fireplace and filled with ashes whereupon closing of said lid permits removal of the shovel and reopening and emptying of the contents at a remote discharge point.

2. A fireplace and cleaning shovel according to claim 9, wherein said hollow handle means is generally square and said rod means projects therethrough and is rotatable therein, and wherein the outer end of said rod means is bent upwardly and the inner end thereof is bent downwardly.

3. A fireplace and cleaning shovel according to claim 2, wherein angled brace means extends between and is attached to the rear of said chamber and said handle means to additionally support the latter.

* * * * *